US005243790A

United States Patent [19]

Gagne

[11] Patent Number: 5,243,790

[45] Date of Patent: Sep. 14, 1993

[54] ABRASIVE MEMBER

[75] Inventor: Yvon Gagne, Mont St. Hilaire, Canada

[73] Assignee: Abrasifs Vega, Inc., Mont. St. Hilaire, Canada

[21] Appl. No.: 904,487

[22] Filed: Jun. 25, 1992

[51] Int. Cl.[5] ..... B24D 7/18; B24D 7/10; B24D 7/14

[52] U.S. Cl. ..... 51/209 R; 51/396; 51/397; 51/398; 51/402

[58] Field of Search ..... 51/209 R, 394, 395, 51/396, 397, 398, 407, 402

[56] References Cited

U.S. PATENT DOCUMENTS

| | | | |
|---|---|---|---|
| 1,116,145 | 11/1914 | Smith | 51/209 DL |
| 1,898,012 | 2/1930 | Hitchcock | 51/110 |
| 2,088,392 | 7/1937 | Waldron | 51/209 S |
| 2,883,807 | 4/1959 | Titcomb | 51/209 R |
| 2,907,146 | 5/1959 | Dyar | 51/397 |
| 3,664,068 | 5/1972 | Metzger et al. | 51/209 |
| 3,898,772 | 8/1975 | Sawluk | 51/209 R |
| 4,037,367 | 7/1977 | Kruse | 51/209 S |
| 4,240,806 | 12/1980 | Frantzen | 51/295 |
| 4,918,872 | 4/1990 | Sato et al. | 51/209 R |
| 5,076,024 | 12/1991 | Akagawa | 51/395 |

FOREIGN PATENT DOCUMENTS

| | | | |
|---|---|---|---|
| 574922 | 4/1959 | Canada | 51/209 |
| 619539 | 5/1961 | Canada | 51/397 |

*Primary Examiner*—Bruce M. Kisliuk
*Assistant Examiner*—Bo Bounkong
*Attorney, Agent, or Firm*—Longacre & White

[57] ABSTRACT

An abrasive member for surfacing a workpiece by rotary abrasion under a flow of liquid, comprises a base and a plurality of abrasive segments protruding from the base. The abrasive segments are shaped and arranged in spaced relation to one another so as to form a network of intersecting primary and secondary channels, the secondary channels cooperating with the primary channels to effect substantially complete scavenging of detritus by centrifugal drainage of waste liquid carrying the detritus through both the primary and secondary channels to the outer periphery of the arrangement of abrasive segments. Each abrasive segment has a planar working surface for abrading contact engagement with the workpiece and a bevelled leading edge which defines a sloping abrasive surface permitting the abrasive segments to ride up over surface irregularities protruding from the workpiece during rotation of the abrasive member, whereby the sloping abrasive surface cooperates with the working surface to grind the surface irregularities without causing chipping of the workpiece.

35 Claims, 6 Drawing Sheets

ABRASIVE MEMBER

BACKGROUND OF THE INVENTION

The present invention relates generally to abrading tools. More particularly, the invention is concerned with an abrasive member for surfacing a workpiece by rotary abrasion.

The surfacing of relatively hard materials such as granite, marble, limestone, concrete, artificial stones, ceramics and hard resins involves several operations. These include lapping, grinding, finishing and prepolishing of the stone surface. The lapping operation comprises bringing down to level a surface lying slightly above another one on a flat surface, and removing marks caused by wiresawing. Small cavities formed in the surface by the lapping operation are then removed by grinding. In the finishing operation, scars left by the grinding operation are removed. The prepolishing operation enables one to eliminate scars having a depth of 4 to 10 microns left by the finishing operation, before the final polishing of the surface with tin or aluminum oxide to achieve the desired glossy finish.

The above operations are generally carried out using an abrasive disc driven by a hand-held, electrically or pneumatically powered tool. Where the workpiece to be surfaced is a slab or floor, use is preferably made of a plurality of abrasive pads mounted on a horizontal turntable. In either case, a center water feed is usually provided to eliminate grinding dust and reduce the health risks associated therewith, while ensuring proper cooling. However, sludge buildup often occurs, causing loading of the abrasive disc or pad.

In order to remove the waste grinding liquid, it has been proposed in U.S. Pat. No. 4,918,872 to secure a plurality of grinding wheel segments in a predetermined arrangement to a rotary driving platen so as to form a plurality of surface grooves extending in a generally radial direction and away from the direction of rotation of the grinding wheel segments, from the inner side toward the outer periphery of the arrangement of segments. Such grooves are effective for removing only part of the waste grinding liquid and are thus unsatisfactory for a complete scavenging of detritus.

U.S. Pat. No. 4,037,367, on the other hand, has proposed rotary grinding disc featuring a network of grooves having a pattern selected to include the mirror image of the sequence of repeating lines or curves, with a view to improving the scavenging effectiveness regardless of whether the disc rotates clockwise or counterclockwise. However, the curvature of the grooves and the criss-crossing thereof are such as to cause accumulation and packing of detritus at the intersections of the grooves. Moreover, since the quadrilateral-shaped working elements which are formed by the network of grooves have sidewalls perpendicular to the surface of the workpiece, chipping of the workpiece often occurs upon impact of the leading sidewalls of the working elements with surface irregularities protruding from the workpiece.

SUMMARY OF THE INVENTION

It is therefore an object of the present invention to provide an abrasive member for surfacing a workpiece by rotary abrasion under a flow of liquid, enabling substantially complete scavenging of detritus while minimizing chipping of the workpiece.

According to one aspect of the invention, there is thus provided an abrasive disc for surfacing a workpiece by rotary abrasion under a flow of liquid, comprising a circular base with a central aperture defining a liquid feed opening and at least two concentric annular series of abrasive segments protruding from the base. The abrasive segments are shaped and arranged in spaced relation to one another so as to form a plurality of arcuate primary channels extending in a generally radial direction and away from the direction of rotation, and at least one concentric circular secondary channel intersecting the primary channels and communicating therewith. Each primary channel defines a circular arc and has inner and outer ends intersected by radii defining therebetween an angle of about 15° to about 45°. The secondary channel cooperates with the primary channels to effect substantially complete scavenging of detritus by centrifugal drainage of waste liquid carrying the detritus through both the primary and secondary channels. Each abrasive segment has a planar working surface for abrading contact engagement with the workpiece and a bevelled leading edge which defines a sloping abrasive surface permitting the abrasive segments to ride up over surface irregularities protruding from the workpiece during rotation of the disc, whereby the sloping abrasive surface cooperates with the working surface to grind the surface irregularities without causing chipping of the workpiece.

The present invention also provides, in another aspect thereof, an abrasive pad adapted to be mounted on a turntable rotatable about a rotation axis, for surfacing a workpiece by rotary abrasion under a flow of liquid. The abrasive pad of the invention comprises a base and a plurality of abrasive segments protruding from the base, the abrasive segments being shaped and arranged in spaced relation to one another so as to form a network of arcuate primary and secondary channels with the secondary channels intersecting the primary channels and communicating therewith. The primary channels define circular arcs having centers spaced along a first line, whereas the secondary channels define circular arcs having centers spaced along a second line intersecting the first line, the first and second lines being inclined at angles of about 30°–75° and about 10°–45°, respectively, relative to a radius generated from the rotation axis and passing through the intersection of the first and second lines. The secondary channels cooperate with the primary channels to effect substantially complete scavenging of detritus by centrifugal drainage of waste liquid carrying the detritus through both the primary and secondary channels. Each abrasive segment has a planar working surface for abrading contact engagement with the workpiece and a bevelled leading edge which defines a sloping abrasive surface permitting the abrasive segments to ride up over surface irregularities protruding from the workpiece during rotation of the turntable, whereby the sloping abrasive surface cooperates with the working surface to grind the surface irregularities without causing chipping of the workpiece.

Applicant has found quite unexpectedly that substantially complete scavenging of detritus can be effected with an abrasive disc by combining a plurality of arcuate primary channels extending in a generally radial direction and away from the direction of rotation, with at least one concentric circular secondary channel intersecting the primary channels and communicating therewith, provided that each primary channel defines a circular arc and has inner and outer ends intersected by radii defining therebetween an angle of about 15° to about 45°. In particular, it has been found that if the angle defined between the radii intersecting the inner and outer ends of each primary channel is less than 15°, there is insufficient evacuation of the waste liquid, resulting in packing of the channels. On the other hand, if the angle is greater than 45°, the evacuation of waste liquid is excessive so that less detritus is carried by the liquid; in addition, since there is not enough liquid retention within the channels, cooling of the abrasive segments by the liquid is inadequate, resulting in undesirable heating up of the abrasive segments. Similarly, in the case of the abrasive pad, if the primary channels are disposed in a manner such that the first line is inclined to the radius at an angle greater than 75°, there is insufficient evacuation of waste liquid; if the angle is less than 30°, the evacuation of waste liquid is excessive.

Applicant has also found quite unexpectedly that by bevelling the leading edge of each abrasive segment such as to define a sloping abrasive surface, it is possible to minimize chipping of the workpiece while maintaining adequate channeling of the waste liquid through the primary channels, as the sloping surface permits the abrasive segments to ride up over surface irregularities protruding from the workpiece during rotation of the disc or turntable and does not interfere with the channeling of the waste liquid. Moreover, since such a sloping surface is abrasive, it cooperates with the working surface to grind the surface irregularities. An inclined surface extending the full height of the abrasive segment, instead of only part thereof as in the case of a bevelled edge, would prevent proper guidance of the waste liquid through the channels and thus interfere with the channeling of waste liquid.

Where the abrasive member of the invention is in the form of a disc, the circular arcs which are defined by the primary channels advantageously have centers equidistantly spaced along a circle concentric with the base. Preferably, an angle of about 10° to about 30° is defined between radii intersecting two successive centers spaced along the circle.

In a preferred embodiment of the invention where the abrasive member is in the form of a pad, the centers of the circular arcs which are defined by the primary and secondary channels are equidistantly spaced along the first and second lines, respectively. Preferably, the first and second lines are inclined at angles of about 60° and about 15°, respectively, relative to the aforementioned radius.

According to a particularly preferred embodiment, the abrasive segments are formed of abrasive particles embedded in a matrix material, each segment comprising a head portion defining the working surface and the sloping abrasive surface, and a body portion intermediate the head portion and the base. The abrasive particles are present in the head portion in a concentration ranging from about 70 to about 90 weight %, preferably 80 weight %. The concentration of abrasive particles in the body portion is in the range of about 30 to about 10 weight %, and is preferably about 20 weight %.

In another preferred embodiment of the invention, the sloping abrasive surface of each abrasive segment intersects a sidewall thereof to define a line of demarcation between the head portion and the body portion, the line of demarcation extending parallel to the working surface and being spaced from the plane thereof by a first distance. Thus, variation of this first distance which corresponds to the thickness of the head portion provides a visual indication of the level of wear of the head portion. The line of demarcation also extends parallel to the base and is spaced therefrom by a second distance. Preferably, the ratio of the first distance to the second distance, which corresponds to the ratio of the respective thicknesses of the head and body portions, ranges from about 3:7 to about 7:3.

According to a further preferred embodiment, the sloping abrasive surface of each abrasive segment intersects the working surface thereof at a bevel angle ranging from about 15° to about 60°. Preferably, the ratio of the first distance to the second distance is about 1:1 and the bevel angle is about 45°.

In addition to permitting a substantially complete scavenging of detritus and minimizing chipping of a workpiece, the abrasive member of the invention significantly reduces the time required for surfacing a workpiece.

BRIEF DESCRIPTION OF THE DRAWINGS

Further features and advantages of the invention will become more readily apparent from the following description of preferred embodiments illustrated by way of examples in the accompanying drawings, wherein.

DESCRIPTION OF PREFERRED EMBODIMENTS

Figure 1:
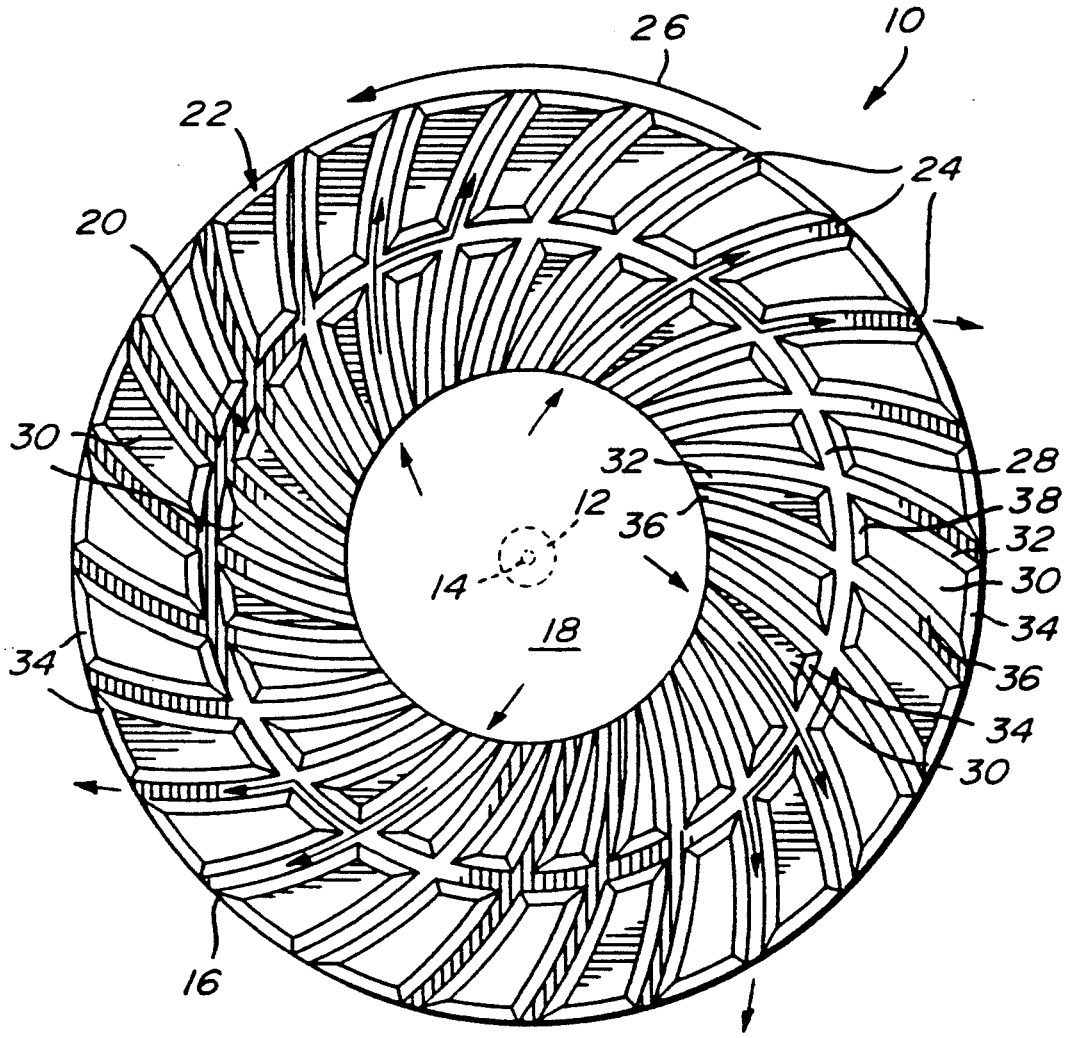
FIG. 1 is a top plan view of an abrasive disc according to a first preferred embodiment of the invention.

Referring first to FIG. 1, there is illustrated an abrasive disc 10 for surfacing a workpiece under a flow of liquid, which disc is adapted to be attached to the wheel of a hand-held, electrically or pneumatically powered tool (not shown) having a spindle 12 provided with an axial conduit 14 for ejecting under pressure a liquid such as water. The abrasive disc 10 comprises a circular base 16 with a central hole 18 defining a liquid feed opening and two concentric annular series of abrasive segments 20,22 protruding from the base 16. The abrasive segments 20,22 are shaped and arranged in spaced relation to one another so as to form a plurality of arcuate primary channels 24 extending in a generally radial direction and away from the direction of rotation represented by the arrow 26, and one concentric circular secondary channel 28 intersecting the primary channels 24 and communicating therewith. The secondary channel 28 cooperates with the primary channels 24 to effect substantially complete scavenging of detritus by centrifugal drainage of waste liquid carrying the detritus through both the primary and secondary channels 24,28 to the outer periphery of the segments 22, as shown by the arrows.

The abrasive segments 20,22 each have a planar working surface 30 for abrading contact engagement with the workpiece and a bevelled leading edge 32 which defines a sloping abrasive surface permitting the segments 20,22 to ride up over surface irregularities protruding from the workpiece during rotation of the disc 10, thereby preventing chipping of the workpiece. The abrasive segments 20,22 also each have a bevelled outer side edge 34 which defines a further sloping abrasive surface permitting the segments to ride up over the surface irregularities during translation of the disc 10. As illustrated, the trailing edges 36 of the segments 20,22 and the inner side edges 38 of the segments 22 are bevelled.

Figure 2:
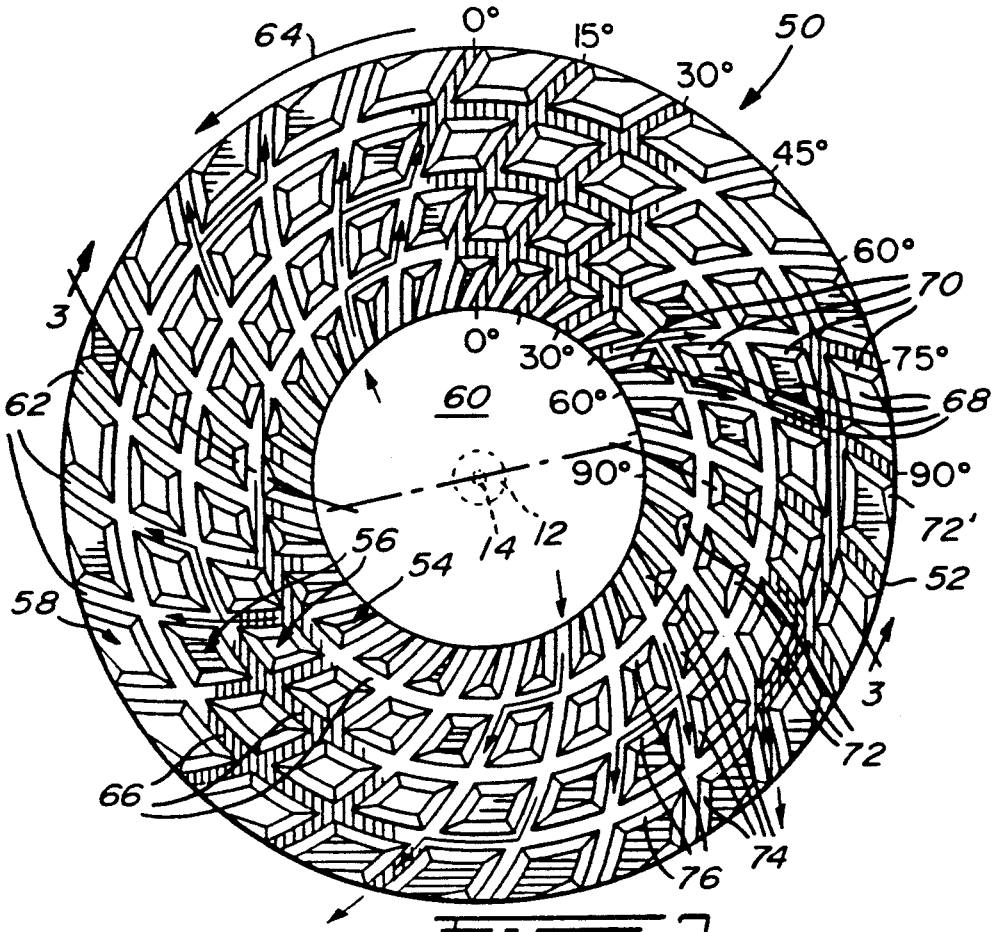
FIG. 2 is a top plan view of an abrasive disc according to a second preferred embodiment of the invention.

FIG. 2 shows an abrasive disc 50 similar to the one illustrated in FIG. 1, with the exception that there are four concentric annular series of abrasive segments protruding from the base 52, i.e. an innermost series of segments 54, two intermediate series of segments 56 and an outermost series of segments 58. A central hole 60 is formed in the base 52 to permit feeding of liquid. The abrasive segments 54,56 and 58 are shaped and spaced from one another so as to form a plurality of arcuate primary channels 62 extending in a generally radial direction and away from the direction of rotation represented by the arrow 64, and three concentric circular secondary channels 66. The abrasive segments 54,56,58 each have a planar working surface 68 and a bevelled leading edge 70 which defines a sloping abrasive surface permitting the segments 54,56,58 to ride up over surface irregularities protruding from a workpiece during rotation of the disc 50. The abrasive segments 54 and 56 of the innermost and intermediate series each have a bevelled outer side edge 72, whereas the abrasive segments 58 of the outermost series each have a bevelled outer side edge portion 72' extending adjacent the leading edge 70. The sloping abrasive surfaces defined by the bevelled outer side edges 72 and bevelled outer side edge portions 72' permit the segments 54, 56 and 58 to ride up over the surface irregularities during translation of the disc 50. Since the abrasive segments 58 are flush with the peripheral wall of the base 52 and the outer side edges thereof are only partially bevelled, the segments 58 also permit the surfacing of a workpiece closely adjacent a wall extending at right angle to the workpiece. As illustrated, the trailing edges 74 of the segments 54,56,58 and the inner side edges 76 of the segments 56,58 are bevelled.

Figure 3:
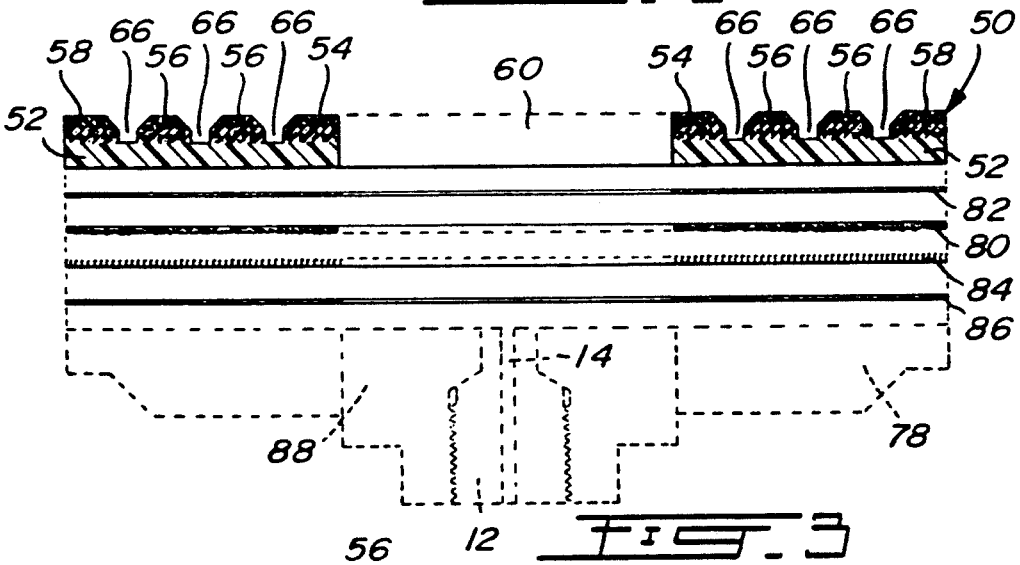
FIG. 3 is a sectional view taken along line 3—3 of FIG. 2, illustrating how the disc may be releasably attached to the wheel of a hand-held, electrically or pneumatically powered tool.

As shown in FIG. 3, the disc 50 can be releasably attached to the wheel 78 of a hand-held, electrically or pneumatically powered tool (not shown) by means of hook and loop fasteners available under the trade mark VELCRO. To this end, the disc 50 is provided with a backing 80 of loop fasteners adhesively bonded to the base 52 by means of an adhesive film 82, and the wheel 78 is provided with a backing 84 of hook fasteners adhesively bonded thereto by means of an adhesive film 86. Such an arrangement permits fast disc changes. The wheel 78 which is made of a resilient material such as rubber is fixed to a rigid support element 88 threadably engaged with the spindle 12. As previously mentioned, a liquid such as water is fed under pressure via the axial conduit 14 through the opening 60 of the disc 50 so as to splatter against the surface of the workpiece. Waste liquid carrying detritus is removed by centrifugal drainage through both the primary and secondary channels 62,66 to the outer periphery of the segments 58, as shown by the arrows in FIG. 2.

The abrasive segments 54,56,58 are integrally formed with the base 52 and comprise abrasive particles embedded in a matrix material. Examples of suitable abrasive materials which can be used in accordance with the invention are diamond fragments, silicon carbide, boron carbide and aluminum oxide. As matrix material, use can be made of a rigid thermoset resin such as an epoxy resin having a Shore D hardness of about 80 to about 90, preferably about 85. If a rigid base 52 is desired, it can be formed of the same thermoset resin used as matrix material. In the embodiment illustrated in FIGS. 2 and 3, however, the base 52 is formed of a resilient thermoset resin imparting flexibility to the base; for example, use can be made of a polyurethane resin having a Shore A hardness of about 70 to about 80, preferably about 75. The rigid and resilient thermoset resins are intimately bonded together through molecular chain interpenetration. This can be achieved by allowing a mixture of abrasive particles, uncured rigid thermoset resin and hardening agent to partially set in a mold and then adding a mixture of uncured resilient thermoset resin and hardening agent, followed by curing.

Figure 3A:
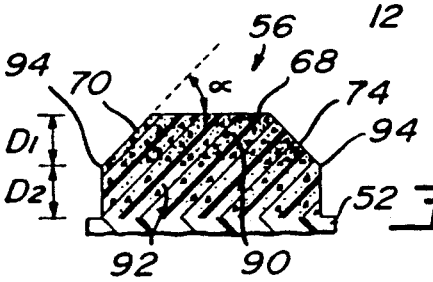
FIG. 3A is a sectional view of an abrasive segment illustrating the distribution of abrasive particles therein.

FIG. 3A illustrates the distribution of abrasive particles in a typical abrasive segment 56. As shown, the segment comprises a head portion 90 and a body portion 92, the abrasive particles being present in the head portion 90 in a higher concentration than in the body portion 92. Typically, the concentrations of abrasive particles in the head portion and body portion are about 80 wt. % and about 20 wt. %, respectively. The sloping surfaces defined by the bevelled edges 70, 72, 74 and 76 (only the bevelled edges 70 and 74 being shown) intersect the sidewalls of the segment to define a peripheral line of demarcation 94 between the head portion 90 and the body portion 92. The line of demarcation 94 is spaced from the plane of the working surface 68 by distance $D_1$ and from the base 52 by distance $D_2$. Variation of the distance $D_1$ which corresponds to the thickness of the head portion 90 provides a visual indication of the level of wear of the head portion. In the embodiment illustrated, the ratio of the distance $D_1$ to the distance $D_2$ is 1:1 and the bevel angle $\alpha$ is about 45°. However, such a ratio can vary from about 3:7 to about 7:3 and the bevel angle $\alpha$ may vary from about 15° to about 60°, provided that the higher the ratio is, the steeper is the bevel angle $\alpha$. This is to ensure proper channeling of the waste liquid through the channels 62 and 66 and an adequate bevel angle to minimize chipping of the workpiece. As the sloping surfaces defined by the bevelled leading edges 70, the bevelled outer side edges 72 and bevelled outer side edge portions 72' are abrasive, they cooperate with the working surfaces 68 to grind surface irregularities protruding from the workpiece during rotation and/or translation of the disc 50.

Figure 4:
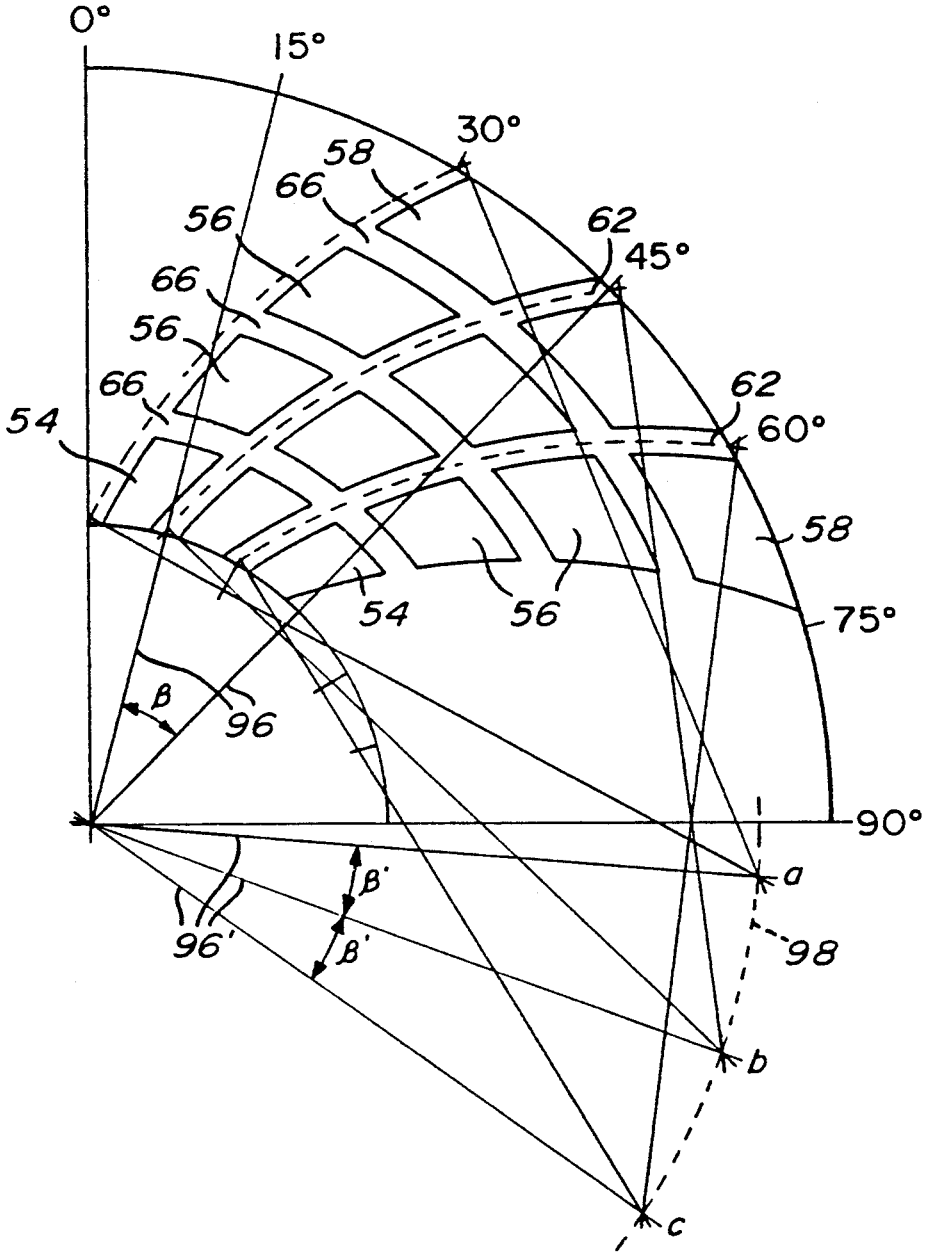
FIG. 4 is a schematic diagram illustrating the geometrical relationship between the primary channels defined in the disc shown in FIG. 2.
Figure 5:
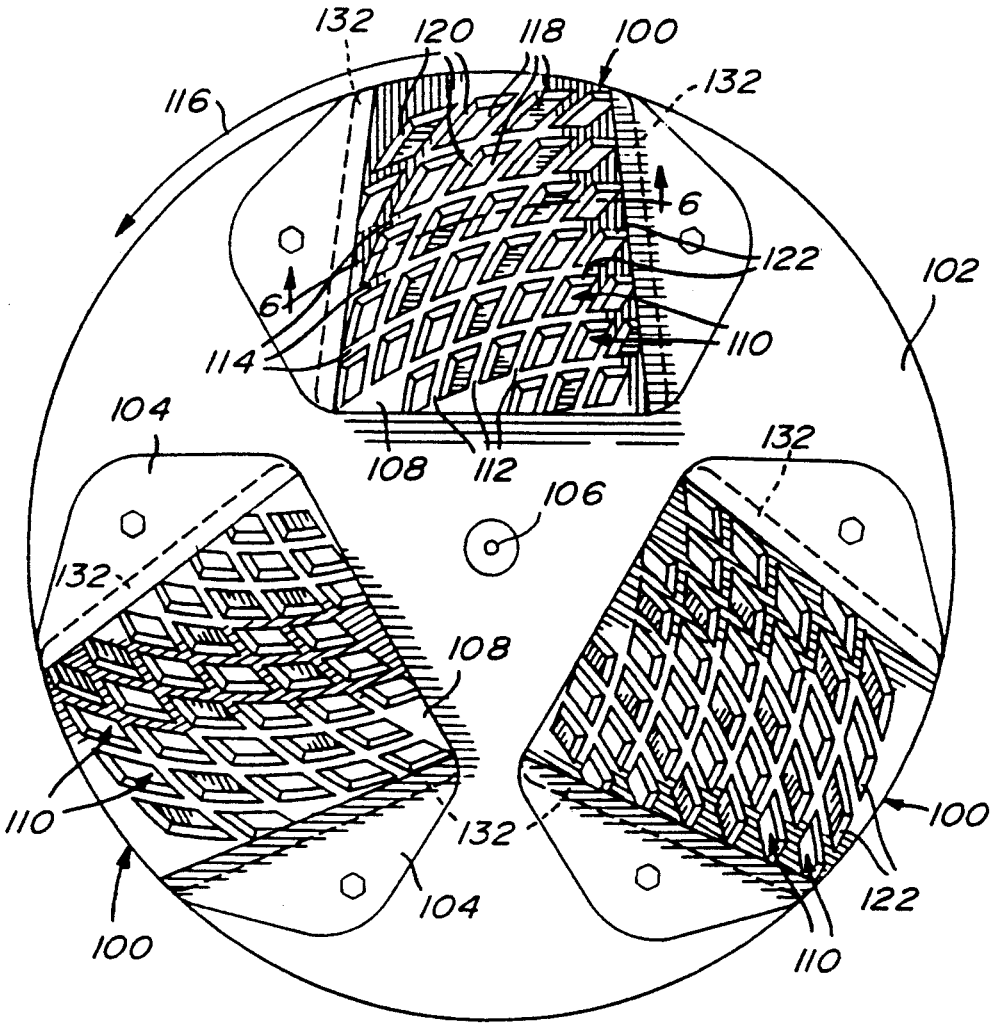
FIG. 5 is a top plan view illustrating a plurality of abrasive pads according to the invention mounted on a horizontal turntable.

Turning to FIG. 4 which illustrates the geometrical relationship between the primary channels 62, the channels 62 have inner and outer ends which are intersected by radii 96 defining therebetween an angle $\beta$. In the embodiment illustrated, the angle $\beta$ is 30°, but as previously explained, this angle may vary between about 15° to about 45°. On the other hand, the circular arcs defined by the channels 62 have centers a, b, c equidistantly spaced along a circle 98 concentric with the base 52. An angle $\beta'$ of 15° is defined between the radii 96' intersecting two successive centers spaced along the circle 98; this angle may vary between about 10° to about 30°.

Where it is desired to surface stone slabs or floors, use is preferably made of the embodiment illustrated in FIG. 5. As shown, a plurality of abrasive pads 100 are mounted on a horizontal turntable 102 by means of brackets 104. The turntable 102 is provided with a central liquid feed opening 106 for ejecting a liquid under pressure. Each abrasive pad 100 comprises a base 108 of trapezoidal configuration and a plurality of abrasive segments 110 protruding from the base 108. The segments 110 are shaped and arranged in spaced relation to one another so as to form a network of arcuate primary and secondary channels 112 and 114 with the secondary channels 114 intersecting the primary channels 112 and communicating therewith. The primary channels 112 extend in a direction away from the direction of rotation represented by the arrow 116.

Each abrasive segments 110 has a planar working surface 118 for abrading contact engagement with a workpiece and a bevelled leading edge 120 which defines a sloping abrasive surface permitting the segments 110 to ride up over surface irregularities protruding from the workpiece during rotation of the turntable 102. The abrasive segments 110 also each have a bevelled outer side edge 122 which defines a further sloping abrasive surface permitting the segments 110 to ride up over the surface irregularities during translation of the turntable 102.

Figure 6:
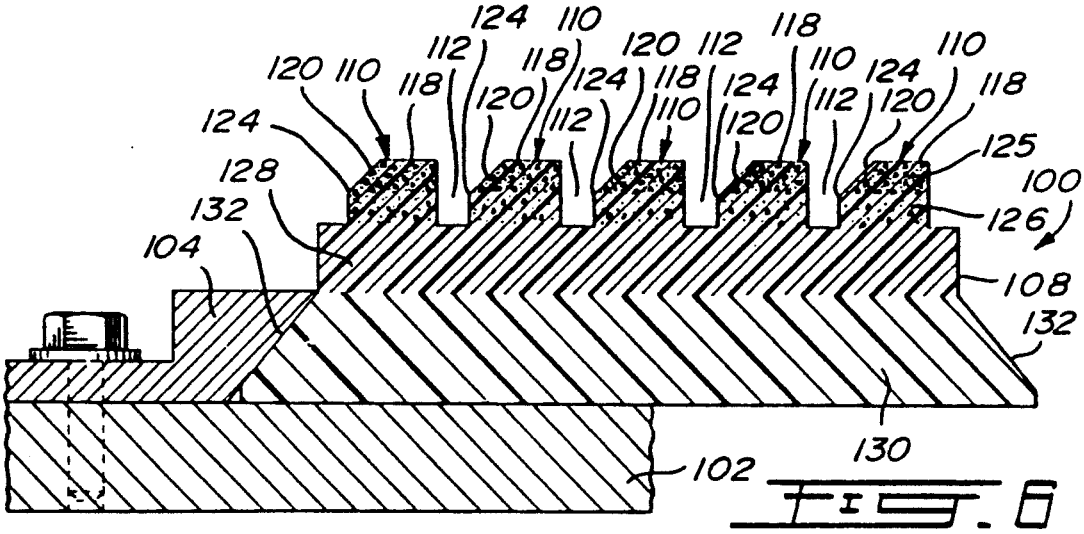
FIG. 6 is a sectional view taken along line 6—6 of FIG. 5.

As shown in FIG. 6, the abrasive segments 110 are integrally formed with the base 108 and comprise abrasive particles embedded in a matrix material. The distribution of abrasive particles in the segments 110 is similar to that illustrated in FIG. 3A; a line of demarcation 124 is similarly defined between the head portion 125 and body portion 126 of each segment 110. The base 108 comprises a segment supporting portion 128 and a shoe portion 130 with inclined sidewalls 132. As matrix material, use is advantageously made of a rigid thermoset resin such as an epoxy resin having a Shore D hardness of about 80 to about 90, preferably 85. The segment supporting portion 128 of the base 108 is formed of the same thermoset resin used as matrix material. The shoe portion 130, on the other hand, is formed of a resilient thermoset resin imparting cushioning properties to the base; for example, use can be made of a polyurethane resin having a Shore A hardness of about 85 to about 100, preferably about 90. The rigid and resilient thermoset resins are intimately bonded together through molecular chain interpenetration.

Figure 7:
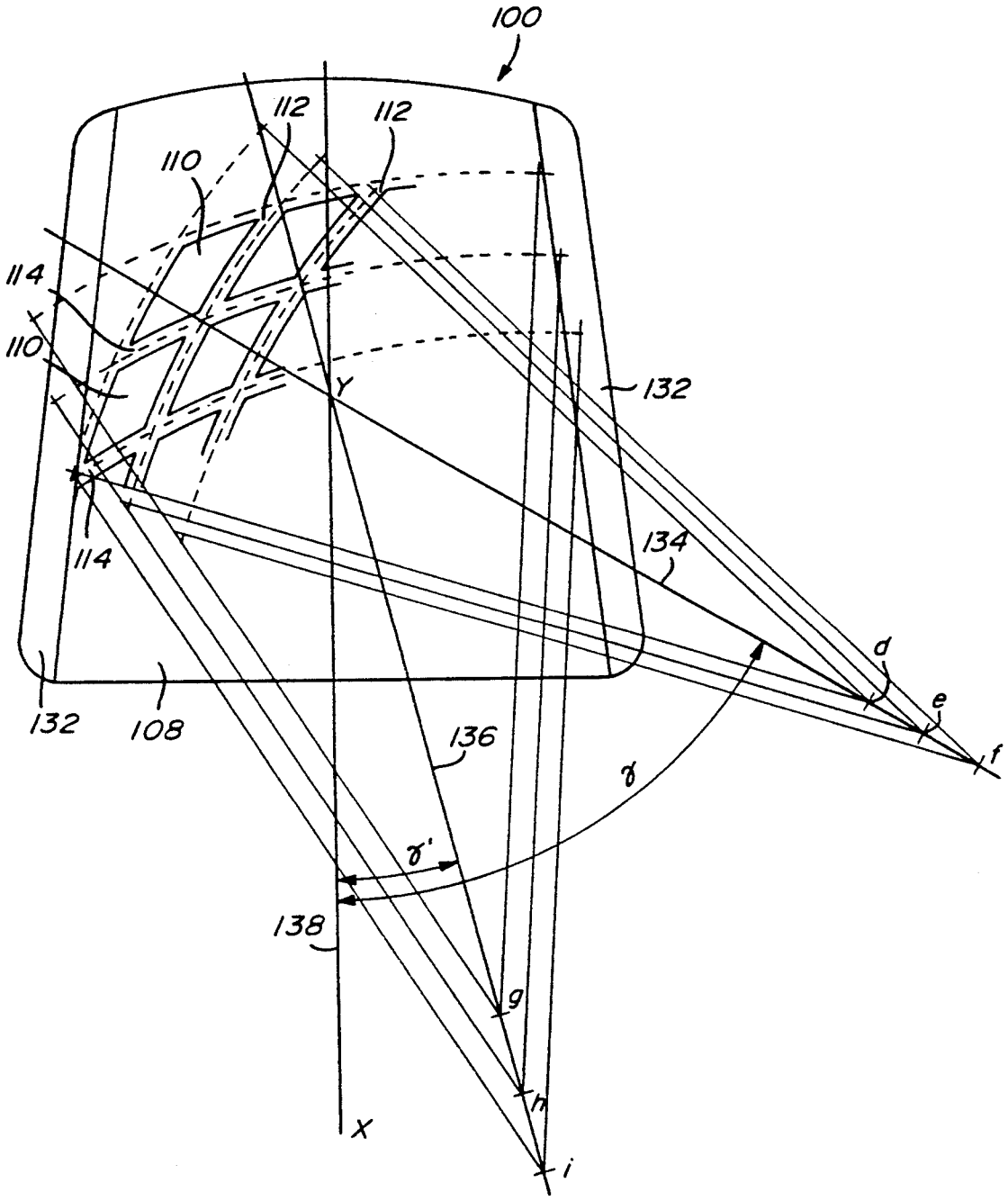
FIG. 7 is a schematic diagram illustrating the geometrical relationship between the primary and secondary channels defined in the pads shown in FIG. 5.

FIG. 7 illustrates the geometrical relationship between the primary and secondary channels 112 and 114 defined by the segments 110. The circular arcs which are defined by the channels 112 have centers d, e, f equidistantly spaced along line 134, whereas the circular arcs which are defined by the channels 114 have centers g, h, i equidistantly spaced along line 136 intersecting line 134 at point Y. Line 134 is inclined at an angle $\gamma$ relative to the radius 138 generated from the rotation axis X of the turntable and passing through the intersection point Y. Line 136, on the other hand, is inclined at an angle $\gamma'$ relative to the radius 138. In the embodiment illustrated, the angles $\gamma$ and $\gamma'$ are about 60° and about 15°, respectively. However, as previously explained, these angles may vary between about 30°–75° and about 10°–45°, respectively. Due to this particular relationship between the primary and secondary channels 112,114, the channels 114 cooperate with the channels 112 to effect a substantially complete scavenging of detritus by centrifugal drainage of waste liquid carrying the detritus through both the primary and secondary channels 112,114 to the outer periphery of the segments 110.

Figure 8A:
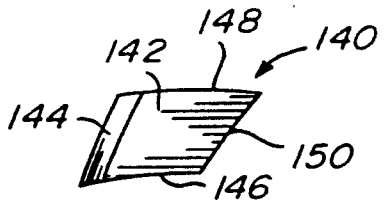
FIGS. 8A through 8G are top plan views of abrasive segments showing various configurations.
Figure 8B:
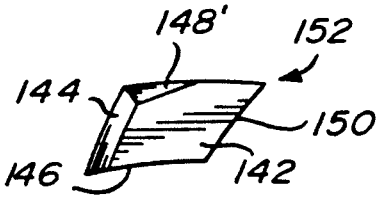

FIGS. 8A through 8G illustrate various configurations which the abrasive segments may have depending upon the intended use. The segment 140 shown in FIG. 8A has a working surface 142 and a bevelled leading edge 144, the inner and outer side edges 146,148 and the trailing edge 150 being straight edges. Such abrasive segments 140 are particularly useful as outermost segments in the finishing and prepolishing operations, for surfacing a workpiece closely adjacent a wall extending at right angle to the workpiece. In FIG. 8B, the abrasive segment 152 has a bevelled outer side edge portion 148' permitting the segment to ride up over surface irregularities protruding from the workpiece during translation of the disc or turntable; the abrasive segments 152 are useful as outermost segments in the lapping and grinding operations, for surfacing a workpiece closely adjacent a wall extending at right angle to the workpiece.

Figure 8C:
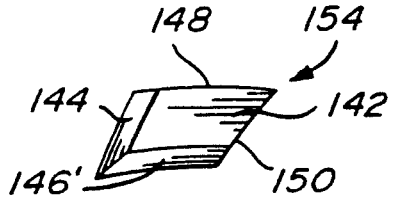
Figure 8D:
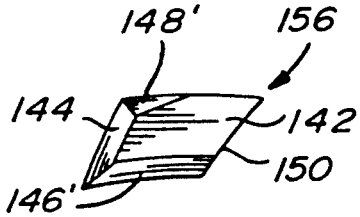
Figure 8E:
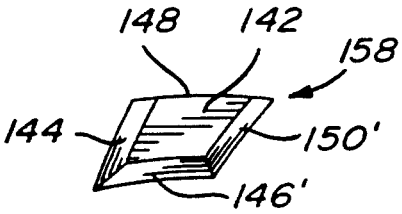
Figure 8F:
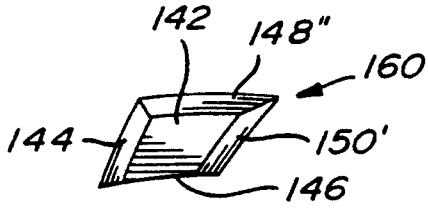
Figure 8G:
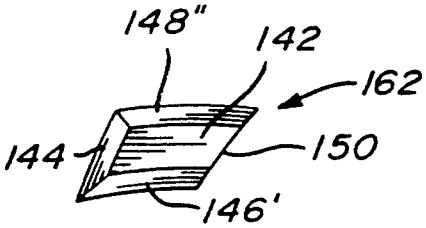

The abrasive segments 154 and 156 shown in FIGS. 8C and 8D have bevelled inner side edges 146' and are particularly useful in operations carried out at high rotation speed. In FIGS. 8E and 8F, the abrasive segments 158 and 160 have bevelled trailing edges 150' and are also useful in operations carried out at high rotation speed. The segment 160 further has a bevelled outer side edge 148'' which renders it useful in lapping and grinding operations, without causing chipping of the workpiece. The abrasive segment 162 shown in FIG. 8G, on the other hand, has a bevelled inner side edge 146' and a straight trailing edge 150.

I claim:

1. An abrasive disc for surfacing a workpiece by rotary abrasion under a flow of liquid, said disc being rotatable about a rotation axis in a predetermined direction of rotation and comprising a circular base with a central aperture defining a liquid feed opening and at least two concentric annular series of abrasive segments protruding from said base, said abrasive segments being shaped and arranged in spaced relation to one another so as to form a plurality of arcuate primary channels extending in a generally radial direction and away from the direction of rotation, and at least one concentric circular secondary channel intersecting said primary channels and communicating therewith, each primary channel defining a circular arc and having inner and outer ends intersected respectively by first and second radii generated from said rotation axis, said first and second radii defining therebetween an angle of about 15° to about 45°, said at least one secondary channel cooperating with said primary channels to effect substantially complete scavenging of detritus by centrifugal drainage of waste liquid carrying said detritus through both said primary and secondary channels, and wherein each abrasive segment has a planar working surface for abrading contact engagement with said workpiece and a beveled leading edge which extends along a respective one of said primary channels and defines a sloping abrasive surface intersecting a sidewall of said respective primary channel at a predetermined distance above said base to thereby permit said abrasive segments to ride up over surface irregularities protruding from said workpiece during rotation of said disc while maintaining channeling of said waste liquid through said primary channels, whereby said sloping abrasive surface cooperates with said working surface to grind said surface irregularities without causing chipping of said workpiece.

2. An abrasive disc as claimed in claim 1, wherein the circular arcs defined by said primary channels have centers equidistantly spaced along a circle concentric with said base.

3. An abrasive disc as claimed in claim 2, wherein an angle of about 30° is defined between the radii intersecting the inner and outer ends of each said primary channel.

4. An abrasive disc as claimed in claim 2, wherein an angle of about 15° is defined between radii intersecting two successive centers spaced along said circle.

5. An abrasive disc as claimed in claim 2, wherein an angle of about 10° to about 30° is defined between radii intersecting two successive centers spaced along said circle.

6. An abrasive disc as claimed in claim 1, wherein there is a plurality of concentric annular series of said abrasive segments, said plurality of series including an innermost series, an outermost series and at least one intermediate series between said innermost and outermost series, and wherein the abrasive segments of the outermost series each have an outer side edge facing outwardly in a direction towards an outer periphery of said disc, said outer side edge having a beveled edge portion which extends adjacent said leading edge and defines a further sloping abrasive surface permitting the abrasive segments of said outermost series to ride up over said surface irregularities during translation of said disc.

7. An abrasive disc as claimed in claim 6, wherein the abrasive segments of the innermost and intermediate series each have a beveled outer side edge facing outwardly in a direction towards the outer periphery of said disc.

8. An abrasive disc as claimed in claim 1, wherein there is a plurality of concentric annular series of said abrasive segments, said plurality of series including an innermost series, an outermost series and at least one intermediate series between said innermost and an outermost series, and wherein the abrasive segments of the outermost series each have an outer side edge facing outwardly in a direction towards an outer periphery of said disc, said outer side edge being beveled to define a further sloping abrasive surface permitting the abrasive segments of said outermost series to ride up over said surface irregularities during translation of said disc.

9. An abrasive disc as claimed in claim 8, wherein the abrasive segments of the innermost and intermediate series each have a beveled outer side edge facing outwardly in a direction towards the outer periphery of said disc.

10. An abrasive disc as claimed in claim 1, wherein said abrasive segments are formed of abrasive particles embedded in a matrix material and each comprise a head portion defining said working surface and said sloping abrasive surface, and a body portion intermediate said head portion and said base, and wherein said abrasive particles are present in said head portion and said body portion in concentrations of about 70–90 weight % and about 30–10 weight %, respectively.

11. An abrasive disc as claimed in claim 10, wherein the concentrations of abrasive particles in said head portion and said body portion are about 80 weight % and about 20 weight %, respectively.

12. An abrasive disc as claimed in claim 10, wherein the sloping abrasive surface of each abrasive segment intersects said sidewall to define a line of demarcation between said head portion and said body portion, and wherein said line of demarcation extends parallel to said working surface and is spaced from the plane of said working surface by a first distance, whereby variation of said first distance provides a visual indication of wear level of said head portion.

13. An abrasive disc as claimed in claim 12, wherein said line of demarcation extends parallel to said base and is spaced therefrom by a second distance corresponding to said predetermined distance, and wherein the ratio of said first distance to said second distance ranges from about 3:7 to about 7:3.

14. An abrasive disc as claimed in claim 13, wherein the sloping abrasive surface of each abrasive segment intersects the working surface thereof at a bevel angle ranging from about 15° to about 60°.

15. An abrasive disc as claimed in claim 14, wherein the ratio of said first distance to said second distance is about 1:1 and wherein said bevel angle is about 45°.

16. An abrasive disc as claimed in claim 10, wherein said abrasive segments are integrally formed with said base.

17. An abrasive disc as claimed in claim 16, wherein said matrix material is a rigid thermoset resin and wherein said base is formed of a resilient thermoset resin imparting flexibility to said base, said rigid and resilient thermoset resins being intimately bonded together through molecular chain interpenetration.

18. An abrasive disc as claimed in claim 17, wherein said rigid thermoset resin is an epoxy resin and said resilient thermoset resin is a polyurethane resin.

19. An abrasive disc as claimed in claim 18, wherein said epoxy resin has a Shore D hardness ranging from about 80 to about 90, and said polyurethane resin has a Shore A hardness ranging from about 70 to about 80.

20. An abrasive pad adapted to be mounted on a turntable rotatable about a rotation axis, for surfacing a workpiece by rotary abrasion under a flow of liquid, said abrasive pad comprising a base and a plurality of abrasive segments protruding from said base, said abrasive segments being shaped and arranged in spaced relation to one another so as to form a network of arcuate primary and secondary channels with said secondary channels intersecting said primary channels and communicating therewith, said primary channels defining circular arcs having centers spaced along a first line and said secondary channels defining circular arcs having centers spaced along a second line intersecting said first line, said first and second lines being inclined at angles of about 30°–75° and about 10°–45°, respectively, relative to a radius generated from said rotation axis and passing through the intersection of said first and second lines, said secondary channels cooperating with said primary channels to effect substantially complete scavenging of detritus by centrifugal drainage of waste liquid carrying said detritus through both said primary and secondary channels, and wherein each abrasive segment has a planar working surface for abrading contact engagement with said workpiece and a beveled leading edge which extends along a respective one of said primary channels and defines a sloping abrasive surface intersecting a sidewall of said respective primary channel at a predetermined distance above said base to thereby permit said abrasive segments to ride up over surface irregularities protruding from said workpiece during rotation of said turntable while maintaining channeling of said waste liquid through said primary channels, whereby said sloping abrasive surface cooperates with said working surface to grind said surface irregularities without causing chipping of said workpiece.

21. An abrasive pad as claimed in claim 20, wherein the centers of the circular arcs defined by said primary channels are equidistantly spaced along said first line.

22. An abrasive pad as claimed in claim 21, wherein said first line is inclined at an angle of about 60° relative to said radius.

23. An abrasive pad as claimed in claim 20, wherein the centers of the circular arcs defined by said secondary channels are equidistantly spaced along said second line.

24. An abrasive pad as claimed in claim 23, wherein said second line is inclined at an angle of about 15° relative to said radius.

25. An abrasive pad as claimed in claim 20, wherein each abrasive segment has a bevelled outer side edge which defines a further sloping abrasive surface permitting said abrasive segments to ride up over said surface irregularities during translation of said turntable.

26. An abrasive pad as claimed in claim 20, wherein said abrasive segments are formed of abrasive particles embedded in a matrix material and each comprise a head portion defining said working surface and said sloping abrasive surface, and a body portion intermediate said head portion and said base, and wherein said abrasive particles are present in said head portion and said body portion in concentrations of about 70–90 weight % and of about 30–10 weight %, respectively.

27. An abrasive pad as claimed in claim 26, wherein the concentrations of abrasive particles in said head portion and said body portion are about 80 weight % and about 20 weight %, respectively.

28. An abrasive pad as claimed in claim 26, wherein the sloping abrasive surface of each abrasive segment intersects said sidewall to define a line of demarcation between said head portion and said body portion, and wherein said line of demarcation extends parallel to said working surface and is spaced from the plane thereof by a first distance, whereby variation of said first distance provides a visual indication of wear level of said head portion.

29. An abrasive pad as claimed in claim 28, wherein said line of demarcation extends parallel to said base and is spaced therefrom by a second distance corresponding to said predetermined distance, and wherein the ratio of said first distance to said second distance ranges from about 3:7 to about 7:3.

30. An abrasive pad as claimed in claim 29, wherein the sloping abrasive surface of each abrasive segment intersects the working surface thereof at a bevel angle ranging from about 15° to about 60°.

31. An abrasive pad as claimed in claim 30, wherein the ratio of said first distance to said second portion is about 1:1 and wherein said bevel angle is about 45°.

32. An abrasive pad as claimed in claim 26, wherein said abrasive segments are integrally formed with said base.

33. An abrasive pad as claimed in claim 32, wherein said matrix material is a rigid thermoset resin and wherein said base comprises a segment supporting portion and a shoe portion adapted to engage said turntable, said segment supporting portion being formed of said thermoset resin and said shoe portion being formed of a resilient thermoset resin imparting cushioning properties to said shoe portion, said rigid and resilient thermoset resins being intimately bonded together through molecular chain interpenetration.

34. An abrasive pad as claimed in claim 33, wherein said rigid thermoset resin is an epoxy resin and said resilient thermoset resin is a polyurethane resin.

35. An abrasive pad as claimed in claim 34, wherein said epoxy resin has a Shore D hardness ranging from about 80 to about 90, and said polyurethane resin has a Shore A hardness ranging from about 85 to about 100.

* * * * *